US008405557B2

(12) United States Patent
Lu

(10) Patent No.: US 8,405,557 B2
(45) Date of Patent: Mar. 26, 2013

(54) ANTENNA FOR PORTABLE ELECTRONIC DEVICE

(75) Inventor: Chun-Yi Lu, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 359 days.

(21) Appl. No.: 12/859,160

(22) Filed: Aug. 18, 2010

(65) Prior Publication Data

US 2011/0187607 A1 Aug. 4, 2011

(30) Foreign Application Priority Data

Jan. 29, 2010 (TW) ..... 99102525 A

(51) Int. Cl.
*H01Q 1/24* (2006.01)

(52) U.S. Cl. ..... 343/702; 343/700 MS; 343/767; 343/893

(58) Field of Classification Search ..... 343/700 MS, 343/702, 718, 728, 741, 767, 818, 866, 876, 343/893, 895
See application file for complete search history.

(56) References Cited

U.S. PATENT DOCUMENTS

| | | | | |
|---|---|---|---|---|
| 6,476,769 | B1 * | 11/2002 | Lehtola | 343/702 |
| 7,053,844 | B2 * | 5/2006 | Gaucher et al. | 343/702 |
| 7,109,923 | B2 * | 9/2006 | Ollikainen et al. | 343/700 MS |
| 7,292,194 | B2 * | 11/2007 | Tai et al. | 343/702 |
| 7,362,277 | B2 * | 4/2008 | Su | 343/702 |
| 7,486,241 | B2 * | 2/2009 | Qi et al. | 343/702 |
| 7,609,213 | B2 * | 10/2009 | Wong et al. | 343/702 |
| 7,714,789 | B2 * | 5/2010 | Tsai et al. | 343/702 |
| 8,106,839 | B2 * | 1/2012 | Tsai et al. | 343/702 |
| 2003/0160728 | A1 * | 8/2003 | Fukushima et al. | 343/702 |
| 2009/0027299 | A1 * | 1/2009 | Peng et al. | 343/893 |

* cited by examiner

*Primary Examiner* — Vibol Tan
(74) *Attorney, Agent, or Firm* — Altis Law Group, Inc.

(57) ABSTRACT

An antenna for a portable electronic device includes a feeding end, a grounding end; and a radiating body. The radiating body includes two symmetrical radiating units respectively connected to the feeding end and the grounding end. Each radiating unit includes a first radiating part, a second radiating part connected to the first radiating part and a third radiating part connected to the second radiating part and surrounded by the first and second radiating parts.

18 Claims, 3 Drawing Sheets

ANTENNA FOR PORTABLE ELECTRONIC DEVICE

BACKGROUND

1. Technical Field

The disclosure generally relates to antennas, particularly to a dipole antenna used to portable electronic devices.

2. Description of Related Art

Commonly, a portable electronic device may receive/send wireless signals of different frequencies, which requires its antenna be suitable for the different frequencies. Generally, the antennas suitable for the different frequencies are difficult to be miniaturized and occupy a large space within the portable wireless communication device.

Therefore, there is room for improvement within the art.

BRIEF DESCRIPTION OF THE DRAWINGS

Many aspects of the antenna for portable electronic device can be better understood with reference to the following drawings. The components in the drawings are not necessarily drawn to scale, the emphasis instead being placed upon clearly illustrating the principles of the antenna for portable electronic device.

DETAILED DESCRIPTION

Figure 1:
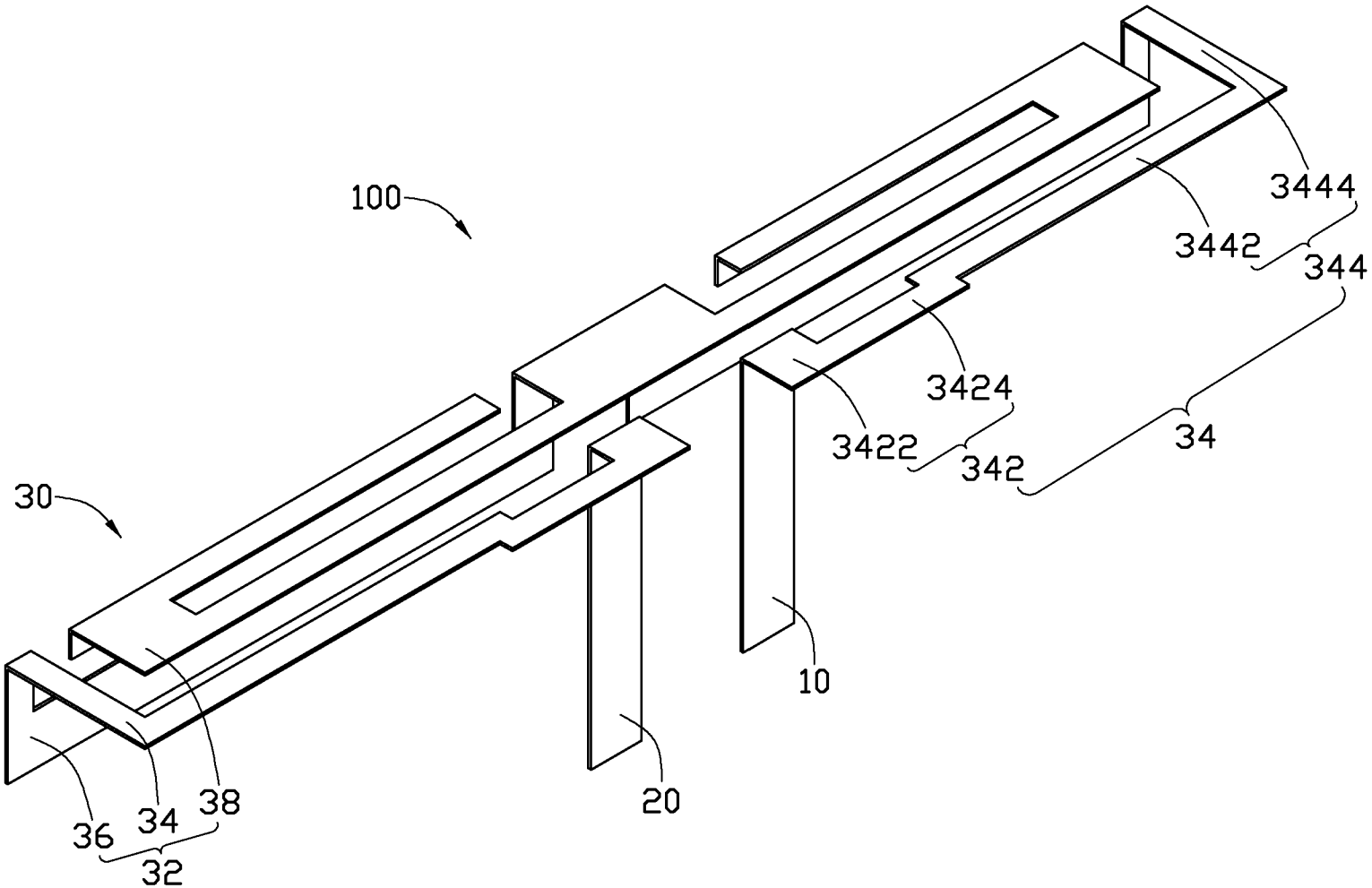
FIG. 1 shows a schematic view of an antenna, according to an exemplary embodiment.

FIG. 1 shows an antenna 100 for a portable electronic device such as a mobile phone or a personal digital assistant (PDA), according to an exemplary embodiment. The antenna 100 is a dipole antenna including a feeding end 10, a grounding end 20 and a radiating body 30 connected to the feeding end 10 and the grounding end 20.

The feeding end 10 is a strip-shaped sheet configured for connecting a feeding point (not shown) of a PCB (not shown) of the portable electronic device and feeding signals.

The grounding end 20 is a strip-shaped sheet configured for connecting a grounding point (not shown) of the PCB of the portable electronic device. The grounding end 20 is parallel to and spaced with the feeding end 10. The grounding end 20 and the feeding end 10 are coplanar. The width of the grounding end 20 is the same as the feeding end 10. The length of the grounding end 20 is slightly longer than the feeding end 10.

The radiating body 30 includes a pair of symmetrical radiating units 32 respectively connected to the feeding end 10 and the grounding end 20. Each radiating unit 32 includes a first radiating part 34, a second radiating part 36 and a third radiating part 38. The first radiating part 34 is connected to the second radiating part 36, and surrounding the third radiating part 38 therein with the second radiating part 36.

The first radiating part 34 includes a first bent portion 342 and a second bent portion 344 connected to the first bent portion 342. The first and second bent portions 342, 344 are substantially L-shaped sheets. The first bent portion 342 includes a first end 3422 and a first edge 3424 perpendicularly connected to the first end 3422. The second bent portion 344 includes a second end 3442 and a second edge 3444 perpendicularly connected to the second end 3442. A distal end of the second edge 3444 opposite to the second end 3442 is connected to an end of the first edge 3424. The second end 3442 is parallel to the first end 3422. In addition, the first ends 3422 of the two radiating units 32 are respectively connected to the feeding end 10 and the grounding end 20.

Figure 2:
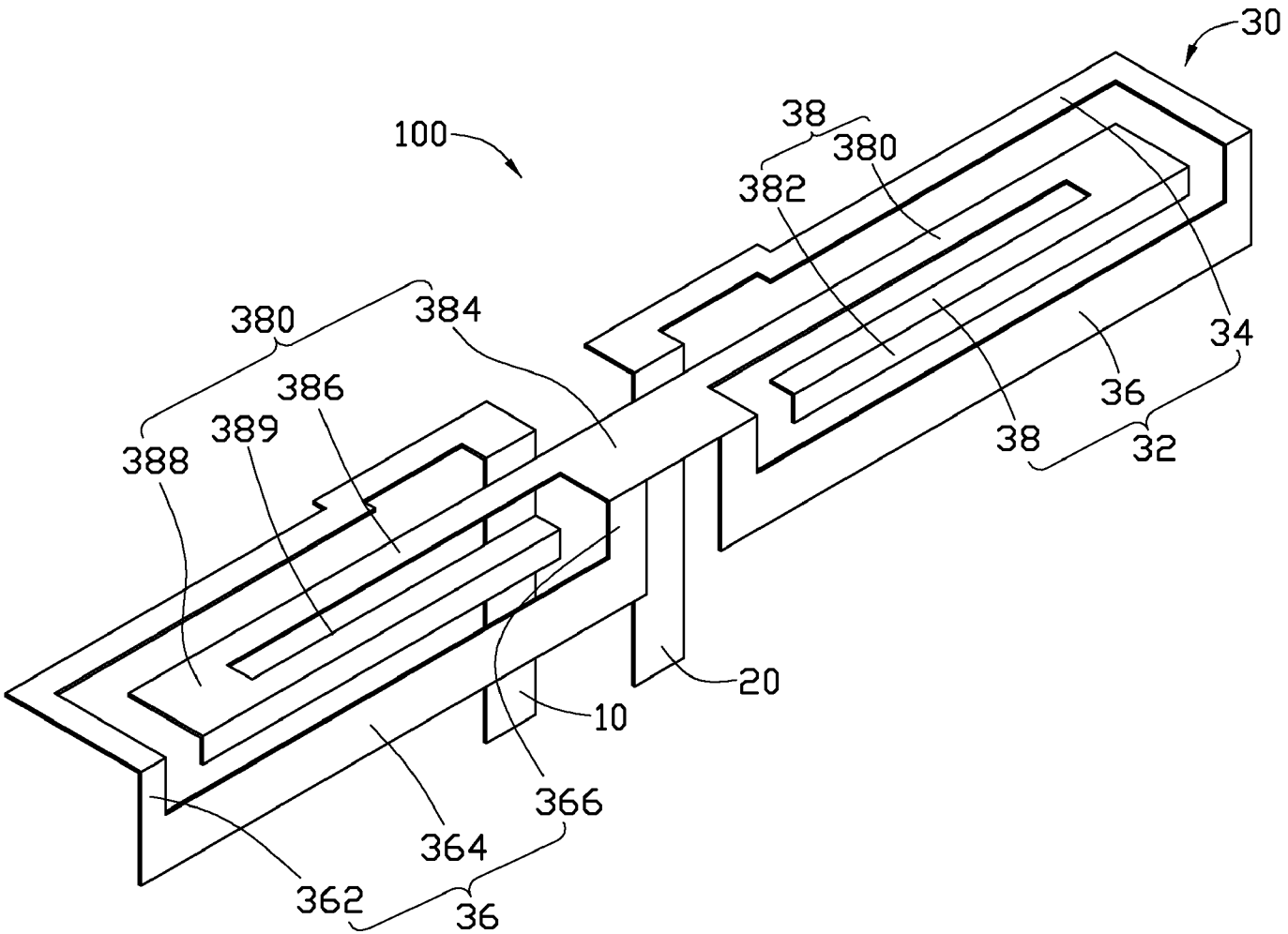
FIG. 2 is similar to FIG. 1, but shown from another aspect.

Referring to FIG. 2, the second radiating part 36 is substantially a U-shaped sheet including a third end 362, a third edge 364, and a fourth end 366. The third end 362 and the fourth end 366 are respectively and perpendicularly connected to two opposite ends of the third edge 364 and parallel to each other. The third end 362 is perpendicularly connected to the second end 3442. Therefore, the first radiating part 34 and the second radiating part 36 are positioned in two perpendicular planes.

The third radiating part 38 includes a main portion 380 and an extended portion 382. The main portion 380 is substantially a rectangular frame having an opening (not labeled). The main portion 380 includes a combination end 384, a first side 386, a connecting end 388, and a second side 389. The combination end 384 and the connecting end 388 are connected to two opposite ends of the first side 386 and parallel to each other. The second side 389 is perpendicularly connected to the connecting end 388 and parallel to the first side 386, and thus forms the frame main portion 380 with the combination end 384, the first side 386 and the connecting end 388. The extended portion 382 perpendicularly extends from an edge of the second side portion 389. Furthermore, the combination end 384 is connected to the second end 366. The third radiating part 38 is surrounded by the first radiating part 34 and the second radiating part 36 and forms the radiating unit 32 therewith. The main portion 380 is coplanar with the first radiating part 34. The extended portion 382 is coplanar with the second radiating part 36. In addition, the two radiating units 32 are combined by connecting the two combination end 384, and form the radiating body 30.

Figure 3:
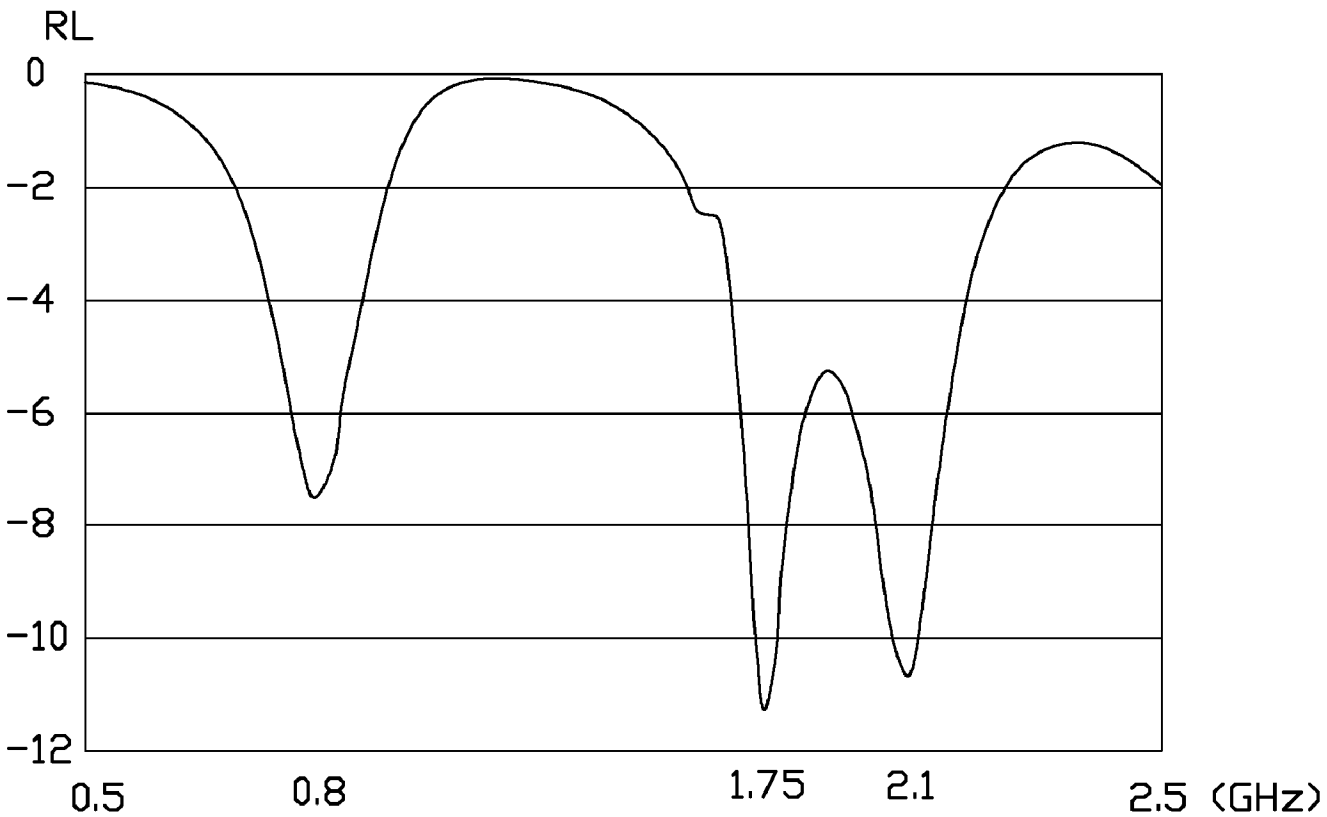
FIG. 3 shows an exemplary test graph obtained from the antenna of FIG. 1, disclosing return loss varying with frequency.

Referring to FIG. 3, as determined from testing, the antenna 10 can be used at three frequencies about 0.8 GHz, 1.75 GHz, and 2.1 GHz. The antenna 10 is suitable for the different operating frequencies and also miniaturized by surrounding the third radiating part 38 with the first radiating part 34 and the second radiating part 36.

In addition, the main portion 380 of the third radiating part 38 is coplanar with the first radiation part 34; the extended portion 382 of the third radiating part 36 is coplanar with the second radiation part 36. Therefore, the antenna 10 can be easily installed in the portable electronic device.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna for a portable electronic device, comprising:

a feeding end;

a grounding end; and a radiating body including two symmetrical radiating units respectively connected to the feeding end and the grounding end; wherein each radiating unit includes a first radiating part, a second radiating part connected to the first radiating part, and a third radiating part connected to the second radiating part and surrounded by the first and second radiating parts; the first radiating part and the second radiating part are positioned in perpendicular planes.

2. The antenna as claimed in claim 1, wherein the first radiating part includes a first bent portion and a second bent portion connected to the first bent portion, the first and second bent portions are L-shaped sheets.

3. The antenna as claimed in claim 2, wherein the first bent portion includes a first end and a first edge perpendicularly connected to the first end, the second bent portion includes a second end and a second edge perpendicularly connected to the second end, a distal end of the second edge opposite to the second end is connected to an end of the first edge, the second end is parallel to the first end.

4. The antenna as claimed in claim 3, wherein the second radiating part includes a third end, a third edge, and a fourth end, the third end and the fourth end are respectively connected to two opposite ends of the third edge and parallel to each other, the third end is connected to the second end.

5. The antenna as claimed in claim 4, wherein the third radiating part includes a main portion and an extended portion extended from the main portion, the main portion is coplanar with the first radiating part, the extended portion is coplanar with the second radiating part.

6. The antenna as claimed in claim 5, wherein the main portion is a frame having an opening.

7. The antenna as claimed in claim 6, wherein the main portion includes a combination end, a first side, a connecting end, and a second side, the combination end and the connecting end are connected to two opposite ends of the first side and parallel to each other, the second side is perpendicularly connected to the connecting end and parallel to the first side.

8. The antenna as claimed in claim 7, wherein the extended portion is a strip extended from an edge of the second side of the main portion.

9. The antenna as claimed in claim 8, wherein the two radiating units are combined by connecting the two combination end.

10. An antenna, comprising:

a feeding end;

a grounding end; and a radiating body including two symmetrical radiating units respectively connected to the feeding end and the grounding end; wherein each radiating unit includes a first radiating part, a second radiating part connected to the first radiating part, and a third radiating part connected to the second radiating part; the third radiating part includes a main portion coplanar with the first radiating part and an extended portion coplanar with the second radiating part; the main portion includes a combination end, a first side, a connecting end, and a second side, the combination end and the connecting end are connected to two opposite ends of the first side and parallel to each other, the second side is perpendicularly connected to the connecting end and parallel to the first side.

11. The antenna as claimed in claim 10, wherein the extended portion is a strip extended from an edge of the second side of the main portion.

12. An antenna for a portable electronic device, comprising:

a feeding end;

a grounding end; and a radiating body including two symmetrical radiating units respectively connected to the feeding end and the grounding end; wherein each radiating unit includes a first radiating part, a second radiating part connected to the first radiating part, and a third radiating part connected to the second radiating part and surrounded by the first and second radiating parts; the first radiating part and the second radiating part are positioned in perpendicular planes; the first radiating part includes a first bent portion and a second bent portion connected to the first bent portion, the first and second bent portions are L-shaped sheets.

13. The antenna as claimed in claim 12, wherein the first bent portion includes a first end and a first edge perpendicularly connected to the first end, the second bent portion includes a second end and a second edge perpendicularly connected to the second end, a distal end of the second edge opposite to the second end is connected to an end of the first edge, the second end is parallel to the first end.

14. The antenna as claimed in claim 13, wherein the second radiating part includes a third end, a third edge, and a fourth end, the third end and the fourth end are respectively connected to two opposite ends of the third edge and parallel to each other, the third end is connected to the second end.

15. The antenna as claimed in claim 14, wherein the third radiating part includes a main portion and an extended portion extended from the main portion, the main portion is coplanar with the first radiating part, the extended portion is coplanar with the second radiating part.

16. The antenna as claimed in claim 15, wherein the main portion includes a combination end, a first side, a connecting end, and a second side, the combination end and the connecting end are connected to two opposite ends of the first side and parallel to each other, the second side is perpendicularly connected to the connecting end and parallel to the first side.

17. The antenna as claimed in claim 16, wherein the extended portion is a strip extended from an edge of the second side of the main portion.

18. The antenna as claimed in claim 17, wherein the two radiating units are combined by connecting the two combination end.

* * * * *